US008247715B2

(12) United States Patent
Yu

(10) Patent No.: US 8,247,715 B2
(45) Date of Patent: Aug. 21, 2012

(54) CIRCUIT BREAKER

(75) Inventor: Yu Yu, Jiangsu (CN)

(73) Assignee: Eaton Corporation, Cleveland, OH (US)

( * ) Notice: Subject to any disclaimer, the term of this patent is extended or adjusted under 35 U.S.C. 154(b) by 303 days.

(21) Appl. No.: 12/764,339

(22) Filed: Apr. 21, 2010

(65) Prior Publication Data

US 2010/0270134 A1 Oct. 28, 2010

(30) Foreign Application Priority Data

Apr. 22, 2009 (CN) ..... 2009 1 0135078

(51) Int. Cl.
*H01H 9/28* (2006.01)

(52) U.S. Cl. ..... 200/43.11

(58) Field of Classification Search ..... 200/43.11, 200/400, 430, 244, 401, 501, 318, 323, 50.4
See application file for complete search history.

(56) References Cited

U.S. PATENT DOCUMENTS 3,258,561 A * 6/1966 Maier ..... 335/9
5,113,056 A * 5/1992 Kuhn ..... 200/400
5,302,788 A * 4/1994 Link et al. ..... 200/401
5,512,720 A * 4/1996 Coudert et al. ..... 200/400

* cited by examiner

*Primary Examiner* — Edwin A. Leon
(74) *Attorney, Agent, or Firm* — Dawn C. Wolff; Martin J. Moran

(57) ABSTRACT

A circuit breaker, comprising a locking device, a secondary cover and a tripbar operatively associated with the locking device. The locking device comprises a lock assembly and a piston assembly operatively coupled with the lock assembly. A through hole for the lock assembly is provided in the secondary cover. The lock assembly has a locked position and an unlocked position, and the piston assembly has a work position and a rest position respectively corresponding to the locked and unlocked positions. The piston assembly is configured to prevent the tripbar from moving to a relatch position when it is in the work position, such that the circuit breaker cannot be turned on. The locking device is configured to be installed on the circuit breaker through the through hole.

8 Claims, 8 Drawing Sheets

CIRCUIT BREAKER

FIELD OF THE INVENTION

The invention relates to a circuit breaker, and more particularly, to a circuit breaker comprising a locking device.

BACKGROUND OF THE INVENTION

Circuit breaker accessories have found increasingly wide application as derivatives from and complements to the functionality of a circuit breaker. One example of a circuit breaker accessory is the breaker locking device, which can be used for locking the circuit breaker in a trip condition or an "OFF" condition when the circuit on the load side of the breaker needs servicing or when it is not allowed to switch on the circuit, so as to prevent the breaker from being turned "ON" by accident, thereby the safety of the service man or the reliable operation of the electric appliance can be ensured.

Currently a circuit breaker equipped with a locking device is seldom seen on the market, and usually the locking device is additionally attached to the circuit breaker at the request of the customer. Typically, the locking device is mounted on the primary cover of the circuit breaker, and for properly fixing the locking device, it may be necessary to specially design the primary cover. Thus, two different sets of molds for molding the primary cover may have to be prepared, respectively for producing a primary cover for a breaker without a locking device and a primary cover for a breaker with a locking device. In this case, the costs involving in the design and production of the primary cover will increase, and the stocks for the two different kinds of primary covers will also increase. In addition, the prior art locking device for a circuit breaker is relatively complicated in structure, and not easy to install and fix.

The invention aims to solve the problems set forth above, that is, to provide a circuit breaker having a locking device that is simple in structure, easy to install and low in cost.

SUMMARY OF THE INVENTION

The invention proposes a circuit breaker locking device with a simple structure, which is capable of being installed by means of a secondary cover of the circuit breaker. The secondary cover is an additional component of the circuit breaker for covering the accessories installed on the primary cover of the breaker.

A circuit breaker according to the invention comprises a locking device, a secondary cover and a tripbar operatively associated with the locking device; the locking device comprises a lock assembly and a piston assembly operatively coupled with the lock assembly; a through hole for the lock assembly is provided in the secondary cover; the lock assembly has a locked position and an unlocked position, and the piston assembly has a work position and a rest position respectively corresponding to the locked and unlocked positions; the piston assembly is configured to prevent the tripbar from moving to a relatch position when the piston assembly is in the work position, such that the circuit breaker cannot be turned on; and the locking device is configured to be installed on the circuit breaker through the through hole.

According to a preferred configuration, the piston assembly includes a piston and a piston base, the piston is capable of being moved relative to the piston base, the piston is configured to protrude out of the piston base while in the work position to prevent the tripbar from moving to the relatch position, and not to impede the movement of the tripbar while in the rest position.

According to another preferred configuration, the lock assembly includes a lock and a cam; the lock includes a fixed portion fixedly mounted in the through hole and a rotatable portion rotatable relative to the fixed portion; the cam and the rotatable portion are capable of jointly rotating between the locked position and the unlocked position; the cam has a shaped working surface configured to push the piston from the rest position to the work position as the cam rotates from the unlocked position to the locked position.

By installing the locking device of the circuit breaker according to the invention on the secondary cover of the breaker, in combination with the specially designed structure of the locking device itself, the locking device can be easily mounted and fixed, and it is not necessary to modify the design of the primary cover of the breaker, thereby the costs for producing the breaker and the stocks for the primary cover will be reduced.

DETAILED DESCRIPTION OF THE INVENTION

The circuit breaker and its locking device according to embodiments of the invention will be described below with reference to the drawings.

Figure 1:
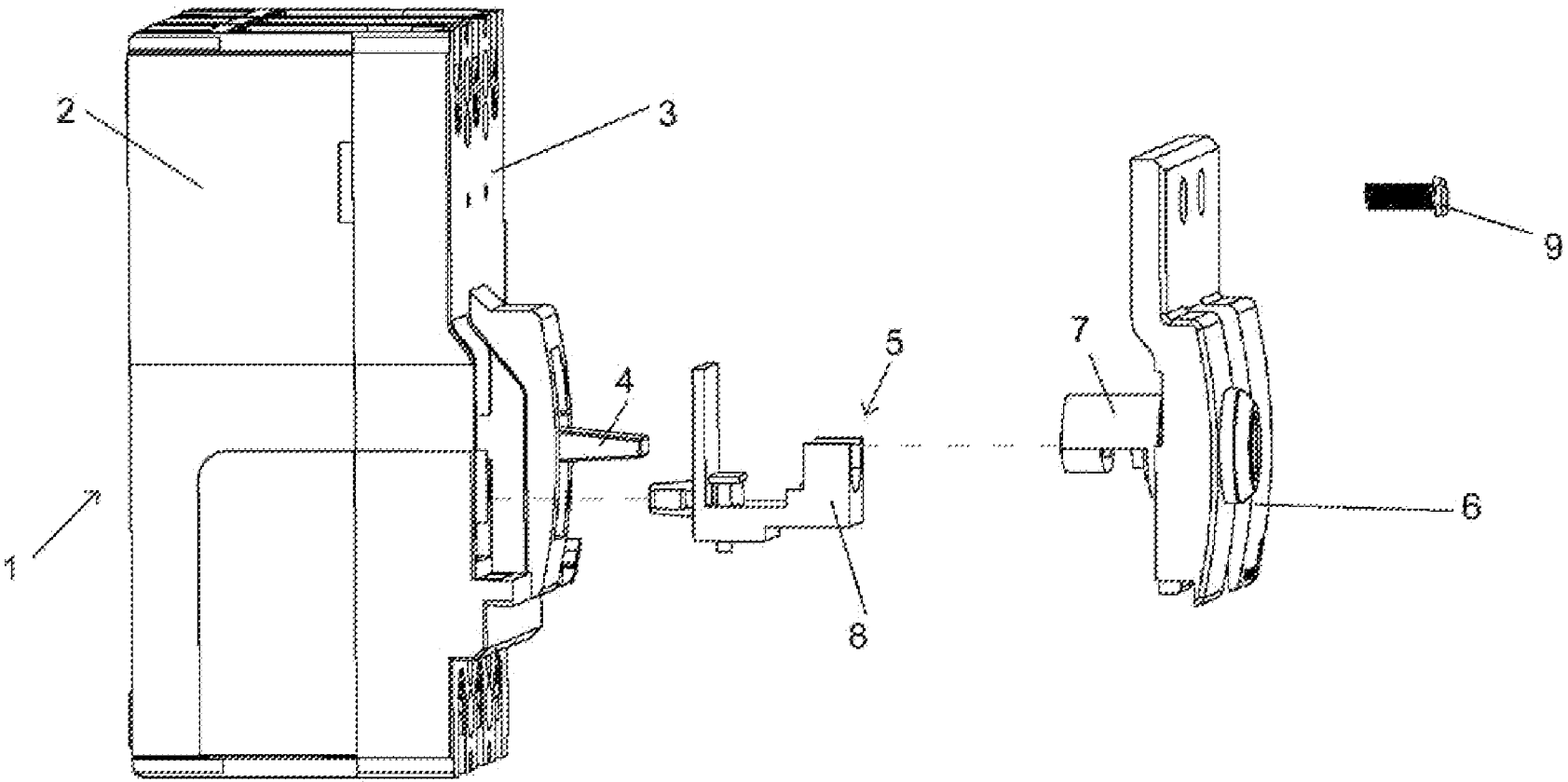
FIG. 1 is an exploded perspective view of a circuit breaker comprising a locking device according to the invention.

As shown in FIG. 1, a circuit breaker 1 according to the invention comprises a housing 2, a primary cover 3, a secondary cover 6 and a handle 4. The main components of the breaker are disposed inside the housing 2 and enclosed by the primary cover 3, while optional accessories (not shown) of the breaker are fixed on the primary cover 3 and covered by the secondary cover 6. The secondary cover 6 is fixed on the primary cover 3 by means of, for example, screws 9, and the handle 4 protrudes from between the left and right lower half portions of the secondary cover 6. As is known by those skilled in the art, the handle 4 possesses three positions, i.e., in an order from top to bottom, an ON position, a trip position, and an OFF (relatch) position, and is connected in a manner well known in the art with components such as a tripbar inside the breaker 1, such that operating the handle 4 to respective positions will accordingly place the breaker 1 into respective conditions (ON, trip and OFF conditions).

Figure 2B:
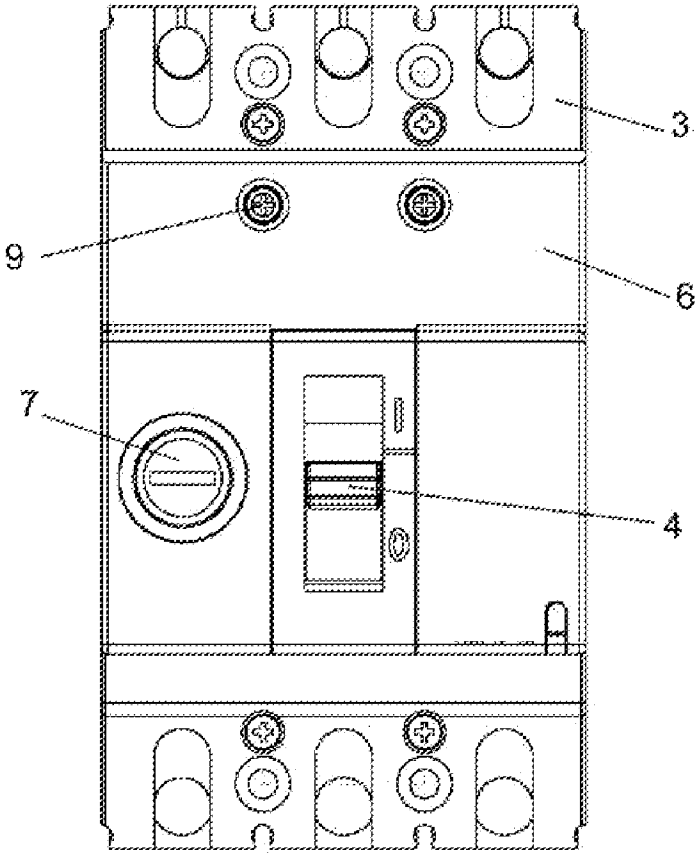
FIGS. 2A and 2B are front views of the circuit breaker comprising the locking device according to the invention in an unlocked and a locked condition, respectively.
Figure 2A:
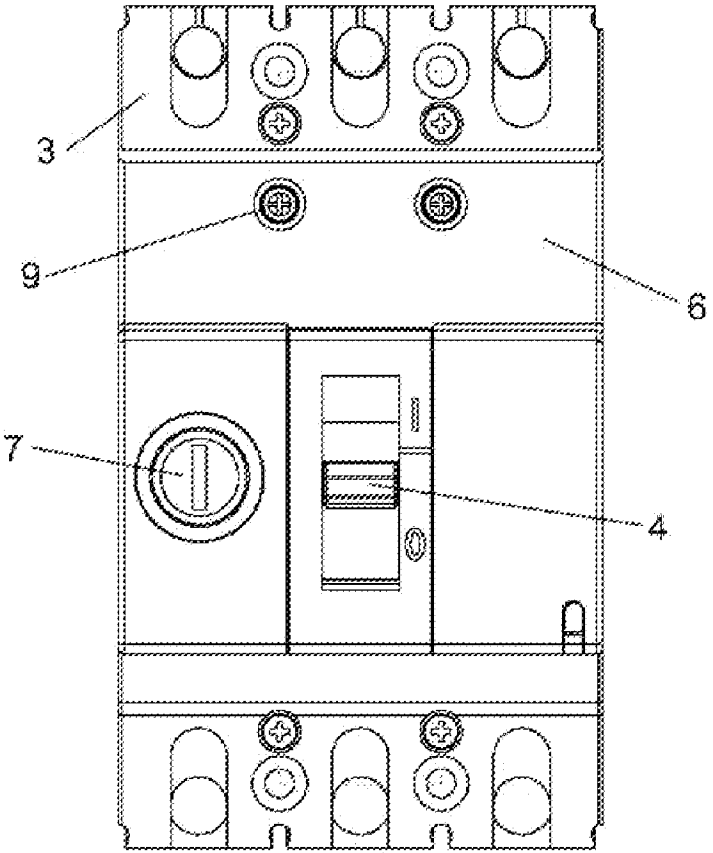
Figure 3:
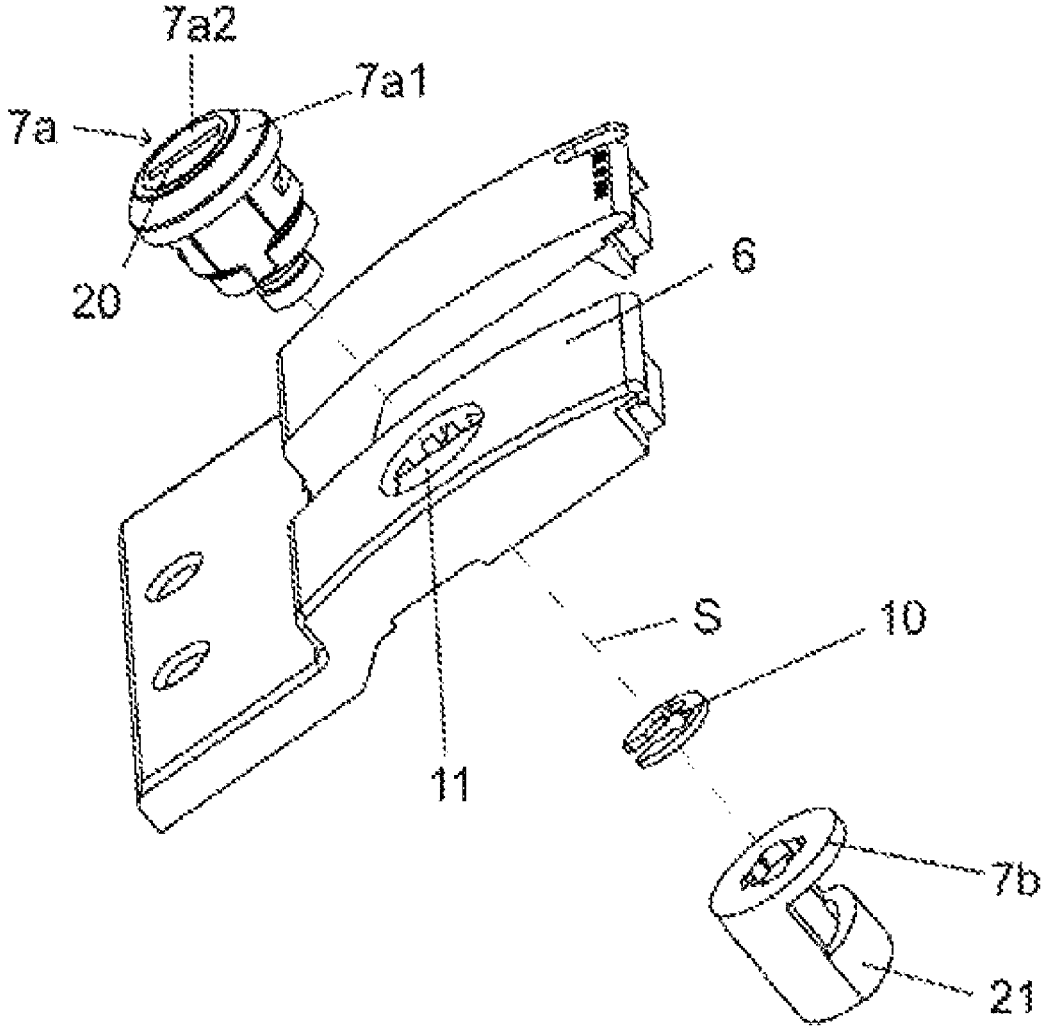
FIG. 3 is an exploded perspective view of a lock assembly of the locking device and a secondary cover of the circuit breaker according to the invention.

A locking device 5 of the circuit breaker 1 according to the invention includes a lock assembly 7 and a piston assembly 8. As shown in FIGS. 1-3, the locking device 5 is removably installed on the breaker 1 through a through hole 11 in the secondary cover 6. In the embodiment, the through hole 11 is made in the left lower half portion of the secondary cover 6, and thus the locking device 5 is correspondingly installed at the left portion of the breaker so as to cooperate with the tripbar inside the breaker to accomplish a locking function (described below in more detail). It is readily conceivable that the locking device 5 may also be installed at a different position on the secondary cover, depending on the location of the tripbar inside the breaker of various types.

Figure 4B:
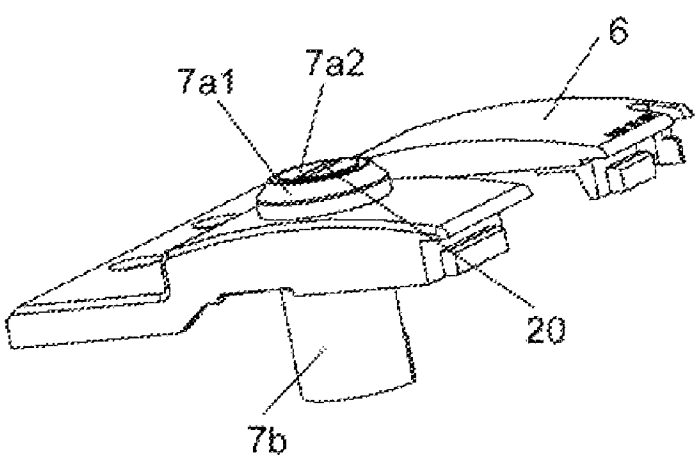
FIGS. 4A and 4B are assembled perspective views of the lock assembly of the locking device and the secondary cover of the circuit breaker according to the invention in an unlocked and a locked position, respectively.
Figure 4A:
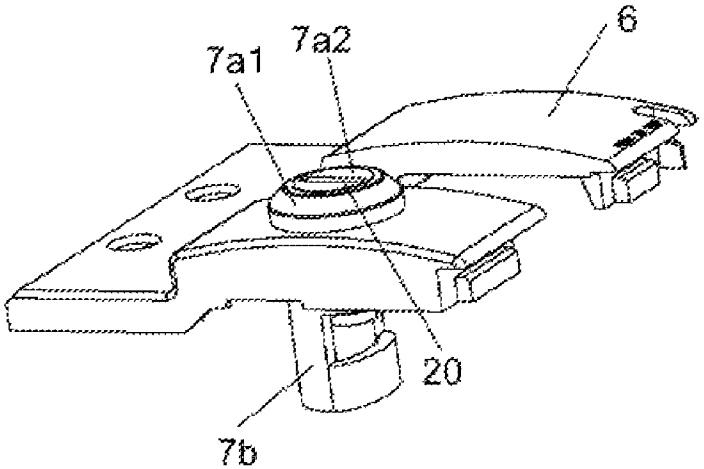

Referring specifically to FIG. 3, the lock assembly 7 includes a lock 7*a* and a cam 7*b*. The lock 7*a* in this embodiment is exemplarily shown as an ordinary cylinder lock, which includes a fixed portion 7*a*1 fixedly mounted in the through hole 11 of the secondary cover 6 by well-known means in the art and a rotatable portion 7*a*2 rotatable relative to the fixed portion 7*a*1, wherein a keyhole 20 is formed in the rotatable portion 7*a*2 for insertion of a key. The cam 7*b*, which comprises a shaped working surface 21 (described below in more detail), is assembled with the rotatable portion 7*a*2 such that they can jointly rotate around an axis S. In addition, as is known in the art, the lock 7*a* and the cam 7*b* can be mounted and fixed all together in the through hole 11 by using a standard part, such as an E-ring 10, to facilitate the installation and location. Since the rotatable portion 7*a*2 and the cam 7*b* are jointly rotatably assembled together, as shown in FIGS. 4A and 4B, as the lock assembly 7 rotates from an unlocked position (with the keyhole 20 being vertically oriented, see FIG. 2A) to a locked position (with the keyhole 20 being horizontally oriented, see FIG. 2B), the cam 7*b*, especially the shaped working surface 21 thereof, rotates correspondingly by a certain angle (here, about 90 degrees) around the axis S.

Figure 5:
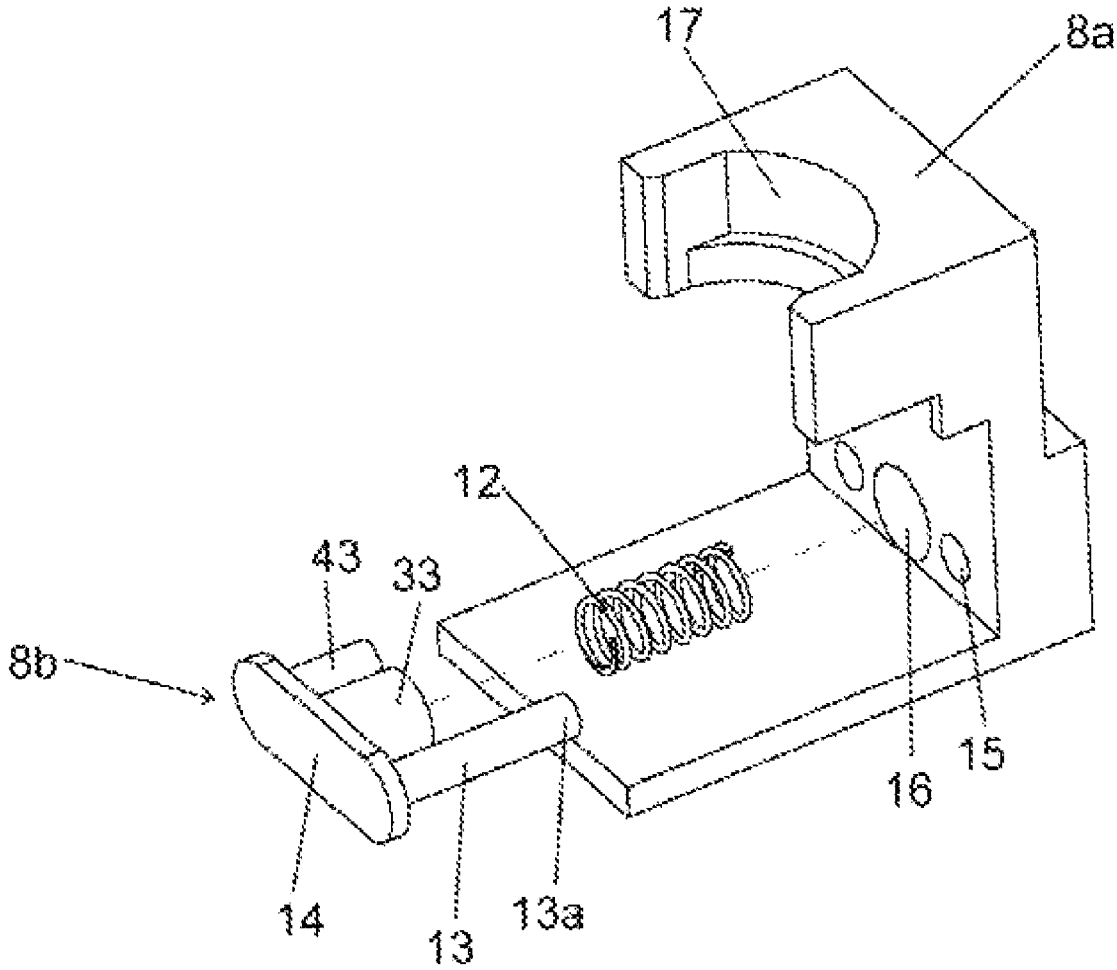
FIG. 5 is an exploded perspective view of a piston assembly of the locking device of the circuit breaker according to the invention.
Figure 6B:
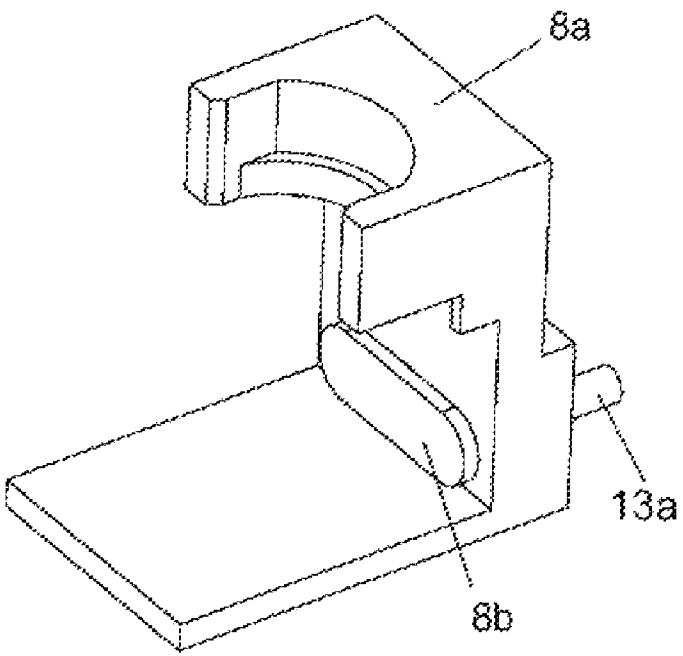
FIGS. 6A and 6B are perspective views of the piston assembly of the locking device of the circuit breaker according to the invention in a rest and a work position, respectively.
Figure 6A:
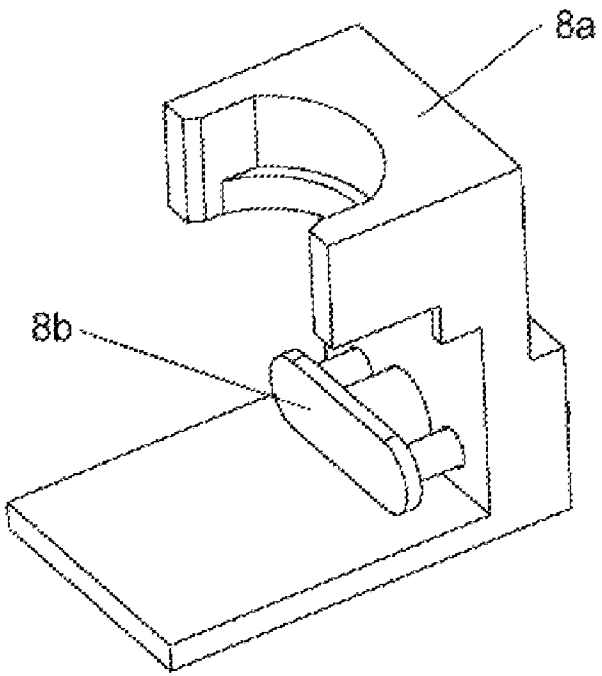

Referring to FIGS. 5 and 6 now, the structure of the piston assembly 8 of the locking device 5 for the circuit breaker according to the invention will be described. As shown in FIG. 5, the piston assembly 8 includes a piston base 8*a* and a piston 8*b*. The piston 8*b* has a base portion 14 and three protrusions protruding from the base portion 14. The three protrusions can be inserted into three corresponding holes in the piston base 8*a*, such that the piston 8*b* can be moved relative to the piston base 8*a*. Among the three protrusions of the piston 8*b*, the longest one is in the form of a push rod 13, which is inserted in a through hole 15 of the piston base 8*a*; the middle one 33 is relatively thick and inserted in a blind hole 16 of the piston base 8*a*; and the third one 43 mainly serves for balancing purpose to enable the piston 8*b* to stably and smoothly move relative to the piston base 8*a*. In the blind hole 16 there is provided a compression spring 12, the two ends of which respectively engage with the protrusion 33 and the bottom of the blind hole 16 after the piston assembly 8 is assembled. As shown in FIGS. 6A and 6B, the piston assembly 8 has a rest position and a work position. In the rest position (FIG. 6A), an end 13*a* of the push rod 13 of the piston 8*b* almost does not protrude beyond the bottom surface of the piston base 8*a* due to the fact that the compression spring 12 biases the protrusion 33 of the piston 8*b*; while in the work position (FIG. 6B), the piston 8*b* overcomes the bias force of the compression spring 12, so that the end 13*a* of the push rod 13 protrudes out of the piston base 8*a*.

Figure 7B:
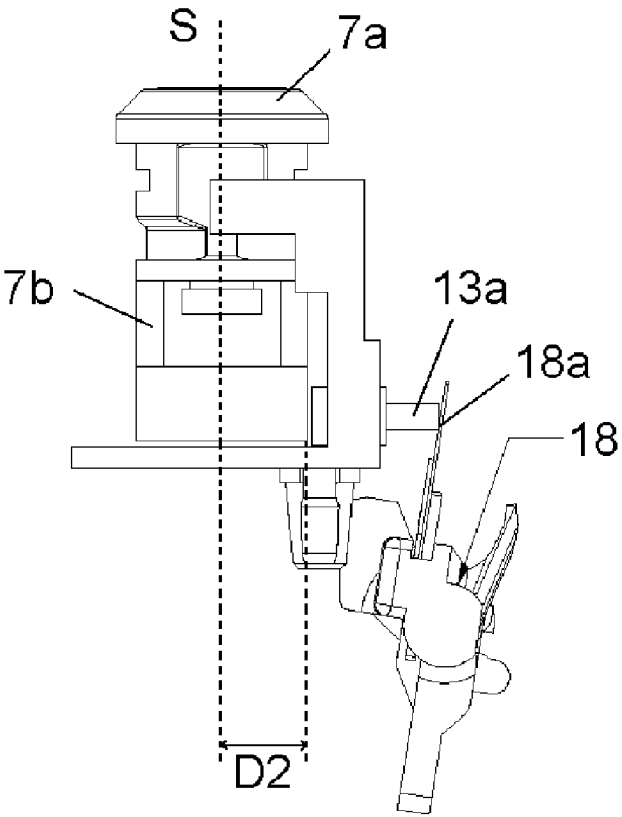
FIGS. 7A and 7B are assembled side views of the locking device and a tripbar of the circuit breaker according to the invention in an unlocked and a locked condition, respectively.
Figure 7A:
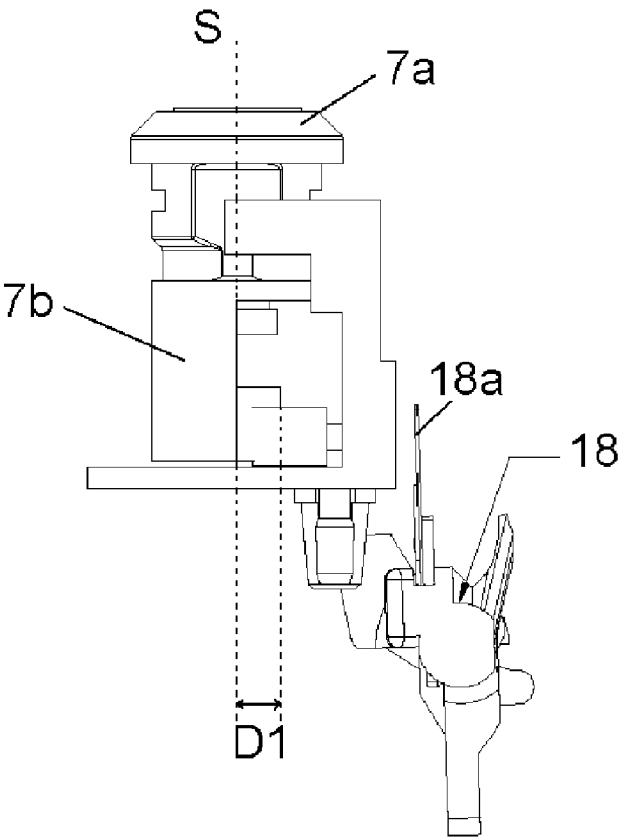

Now the operation of the locking device of the circuit breaker according to the invention will be described below. As shown in FIGS. 7A and 7B, the lock assembly 7 and the piston assembly 8 are assembled together, wherein a recess 17 of the piston base 8*a* is fitted around the cylindrical periphery of the lock 7*a*, and the shaped working surface 21 of the cam 7*b* is operatively engaged with the end face of the base portion 14 of the piston 8*b*. FIG. 7 also shows the tripbar 18 of the breaker, which, as is well known in the art, can be configured as being pivotable around an axis that is perpendicular to the drawing plane of FIG. 7. In FIG. 7A the tripbar 18 is shown in a work position in which the breaker is in an ON condition or has been relatched, while in FIG. 7B the tripbar 18 is shown as having been rotated by a certain angle to reach a trip position. A sheet member 18*a* is fixed on the tripbar 18, and the lock assembly 7 and the piston assembly 8 are sized such that the cross section of the push rod 13 of the piston 8*b* can be aligned with the sheet member 18*a* along the length direction of the axis S, thereby it is possible for the end 13*a* of the push rod 13 to be contacted with the sheet member 18*a*.

Figure 8B:
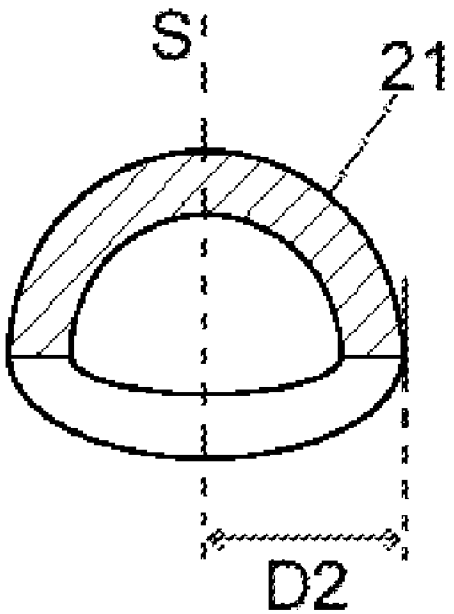
FIGS. 8A and 8B are sectional views of a cam of the locking device of the circuit breaker according to the invention in an unlocked and a locked condition, respectively.
Figure 8A:
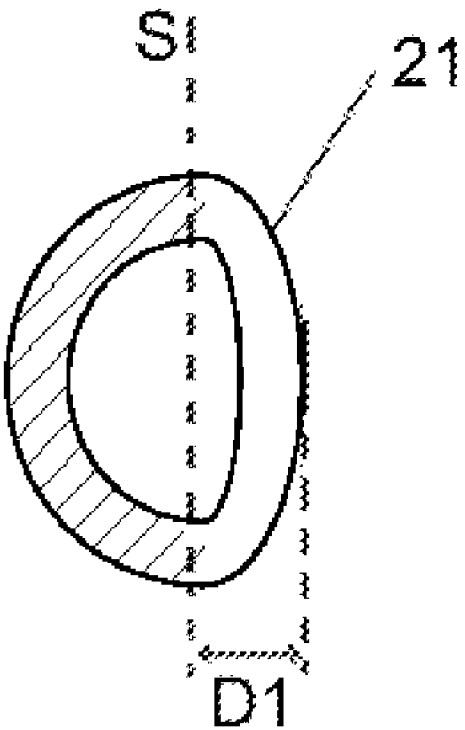

As shown in FIG. 7A, the lock assembly 7 is in the unlocked position and the cam 7*b* is in an unlocked condition, in which a distance between the rightmost contour in the drawing of the shaped working surface 21 and the axis S is D1 (also see FIG. 8A); Correspondingly, the piston assembly 8 is in the rest position, in which the end face of the piston 8*b* abuts against the shaped working surface 21 of the cam 7*b* under the bias of the compression spring 12 and the end 13*a* of the push rod 13 retracts to be inside the piston base 8*a*. Under this condition, the tripbar 18 is freely pivotable without any restriction between a position, in which the breaker is in an ON condition or has been relatched, and the trip position, thereby the breaker can operate normally.

When the operator inserts a key into the keyhole 20 to rotate the rotatable portion 7*a*2 of the lock 7*a* and thus the cam 7*b* from the unlocked position by about 90 degrees to the locked position, the distance between the rightmost contour in the drawing of the shaped working surface 21 of the cam 7*b* and the axis S is gradually increased to D2 (see FIGS. 7B and 8B), meanwhile the shaped working surface 21 pushes the piston 8*b* against the biasing force of the compression spring 12 until the end face of base portion 14 of the piston 8*b* that is opposed to the piston base contacts with the piston base 8*a*. In the meantime, the push rod 13 gradually moves rightwards, and the end 13*a* thereof abuts against the sheet member 18*a* and pushes the sheet member 18*a* rightwards, thereby pivoting the tripbar 18 to the trip position and restricting it in the trip position. Thus, the tripbar 18 is prevented from pivoting leftwards to the relatch position, such that the breaker cannot be relatched and turned ON after it is tripped, thereby the breaker is locked.

When the operator unlocks the locking device, the above procedure steps are reversed, that is, the cam 7*b* rotates from the locked position as shown in FIG. 7B to the unlocked position as shown in FIG. 7A, such that the distance between the rightmost contour in the drawing of the shaped working surface 21 and the axis S is gradually decreased to D1 from D2, and thus the piston 8*b* retracts into the piston base 8*a* while abutting against the shaped working surface 21 under the bias of the compression spring 12, thereby the tripbar 18 becomes free from restriction on the position thereof. Therefore, the tripbar 18 is freely pivotable between the position in which the breaker is turned ON or has been relatched and the trip position, and thus the breaker can operate normally.

It will be understood that, the invention is not limited to the exemplary embodiments as described hereinabove and various modifications can be made by the skilled in the art without departing from the scope and spirits of the invention.

What is claimed is:

1. A circuit breaker, comprising a locking device, a secondary cover and a tripbar operatively associated with the locking device;

the locking device comprises a lock assembly and a piston assembly operatively coupled with the lock assembly;

a through hole for the lock assembly is provided in the secondary cover;

the lock assembly has a locked position and an unlocked position, and the piston assembly has a work position and a rest position respectively corresponding to the locked and unlocked positions;

the piston assembly is configured to prevent the tripbar from moving to a relatch position when the piston assembly is in the work position, such that the circuit breaker cannot be turned on; and the locking device is configured to be installed on the circuit breaker through the through hole.

2. The circuit breaker according to claim 1, wherein the piston assembly includes a piston and a piston base, the piston is capable of being moved relative to the piston base, the piston is configured to protrude out of the piston base while in the work position to prevent the tripbar from moving to the relatch position, and not to impede the movement of the tripbar while in the rest position.

3. The circuit breaker according to claim 2, wherein in the work position, an end of the piston that protrudes out of the piston base abuts against a sheet member provided on the tripbar to restrict the tripbar in a trip position.

4. The circuit breaker according to claim 2, wherein the lock assembly includes a lock and a cam, the lock includes a fixed portion fixedly mounted in the through hole and a rotatable portion rotatable relative to the fixed portion, the cam and the rotatable portion are capable of jointly rotating between the locked position and the unlocked position, the cam has a shaped working surface configured to push the piston from the rest position to the work position as the cam rotates from the unlocked position to the locked position.

5. The circuit breaker according to claim 4, wherein the piston assembly further comprises a resilient member provided between the piston and the piston base to apply a biasing force.

6. The circuit breaker according to claim 5, wherein the shaped working surface of the cam is further configured to allow the piston to return to the rest position from the work position under the action of the resilient member as the cam rotates from the locked position to the unlocked position.

7. The circuit breaker according to claim 6, wherein the piston base has three holes, the piston has three protrusions each being configured to be engaged with one of the three holes, one of the three protrusions is configured to prevent the tripbar from moving to the relatch position when the piston assembly is in the work position, and another one of the three protrusions is engaged with the resilient member.

8. The circuit breaker according to claim 1, wherein the lock assembly is configured such that, when the circuit breaker is in an ON condition, moving the lock assembly from the unlocked position to the locked position will trip the circuit breaker.

* * * * *